US011312560B1

(12) United States Patent
Johnson

(10) Patent No.: US 11,312,560 B1
(45) Date of Patent: Apr. 26, 2022

(54) STORAGE BIN FOR LIGHT SENSITIVE MEDICATION

(71) Applicant: Pamela Johnson, Jacksonville, FL (US)

(72) Inventor: Pamela Johnson, Jacksonville, FL (US)

( * ) Notice: Subject to any disclaimer, the term of this patent is extended or adjusted under 35 U.S.C. 154(b) by 243 days.

(21) Appl. No.: 16/692,759

(22) Filed: Nov. 22, 2019

(51) Int. Cl.

| | |
|---|---|
| ***A61J 7/04*** | (2006.01) |
| ***B65D 81/30*** | (2006.01) |
| ***A61J 1/03*** | (2006.01) |
| ***B65D 25/04*** | (2006.01) |
| ***B65D 43/16*** | (2006.01) |

(52) U.S. Cl.
CPC ..... *B65D 81/30* (2013.01); *A61J 1/03* (2013.01); *B65D 25/04* (2013.01); *B65D 43/161* (2013.01); *A61J 2205/30* (2013.01); *B65D 2203/02* (2013.01); *B65D 2543/00231* (2013.01); *B65D 2543/00296* (2013.01)

(58) Field of Classification Search
CPC ..... B65D 81/30; B65D 25/04; B65D 43/161; B65D 43/00231; B65D 2203/02; A61J 7/04; A61J 7/02; A61J 1/03; A61J 2205/30
USPC ..... 206/534; 312/244, 290, 245
See application file for complete search history.

(56) References Cited

U.S. PATENT DOCUMENTS

| | | | | |
|---|---|---|---|---|
| 5,351,818 | A * | 10/1994 | Daneshvar | A61J 1/03 206/216 |
| 6,338,535 | B1 | 1/2002 | Rickert | |
| 6,758,338 | B2 * | 7/2004 | Lien | B65D 25/10 206/534 |
| 2009/0127155 | A1 * | 5/2009 | Nottoli | B65D 83/0463 206/531 |
| 2015/0108027 | A1 * | 4/2015 | Horn | A61J 7/04 206/459.1 |

* cited by examiner

*Primary Examiner* — King M Chu
(74) *Attorney, Agent, or Firm* — Sanchelima & Associates, P.A.; Christian Sanchelima; Jesus Sanchelima

(57) ABSTRACT

A system for a storage container for light sensitive medications including a container assembly and a cover assembly is disclosed. The container assembly includes a container in which the medications are held and stored within. The container includes dividers secured within the container with divider holders and divider guides located on the sidewalls and floor, respectively, of the container. The dividers help organize the medications stored within each storage container. The cover assembly includes a cover that is hidgedly mounted to the container. Importantly, the cover is tinted an amber color to provide protection from light damage to the medications while still permitting visibility of the medications within the container with the cover closed. The cover includes a lifting handle at a front portion for achieving the open and closed configuration of the storage container. Additionally, the storage containers can be stacked atop of one another.

16 Claims, 6 Drawing Sheets

STORAGE BIN FOR LIGHT SENSITIVE MEDICATION

II. BACKGROUND OF THE INVENTION

1. Field of the Invention

The present invention relates to a storage bin and, more particularly, to a storage bin with a tinted cover for reducing the amount of light exposure to the light sensitive medications stored inside of the storage bin.

2. Description of the Related Art

Several designs for storage bins have been designed in the past. None of them, however, include a pill or medication storage container comprising a rectangular box with a retractable plastic cover wherein the cover is made from a tinted amber colored material for reducing the amount of light exposure to the contents inside the container.

Applicant believes that a related reference corresponds to U.S. Pat. No. 5,351,818 for a rectangular pill or medication storage box. Applicant believes another related reference relates to U.S. Pat. No. 6,338,535 for a pill organizing storage container. None of these references, however, teach of a storage container having a retractable cover that is made from a tinted amber colored material for reducing the light exposure to the contents inside of the container.

Other documents describing the closest subject matter provide for a number of more or less complicated features that fail to solve the problem in an efficient and economical way. None of these patents suggest the novel features of the present invention.

III. SUMMARY OF THE INVENTION

It is one of the objects of the present invention to provide a storage bin for light sensitive medications that helps to extend the shelf life the medications.

It is another object of this invention to provide a storage bin for light sensitive medications that allows for organizing of the medications within with compartments.

It is still another object of the present invention to provide a storage bin for light sensitive medications that includes a tinted cover for reducing the light exposure received by the medications stored inside.

It is another object of the present invention to provide a storage bin for light sensitive medications that helps to reduce any possible damage medications may receive from light exposure.

It is still another object of the present invention to provide a storage bin for light sensitive medications with a tinted cover that allows for visibly of the medications stored inside while still providing light protection to the medications.

It is another object of the present invention to provide a storage bin for light sensitive medications that is stackable upon other storage bins for light sensitive medications.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which.

V. DETAILED DESCRIPTION OF THE EMBODIMENTS OF THE INVENTION

Figure 1:
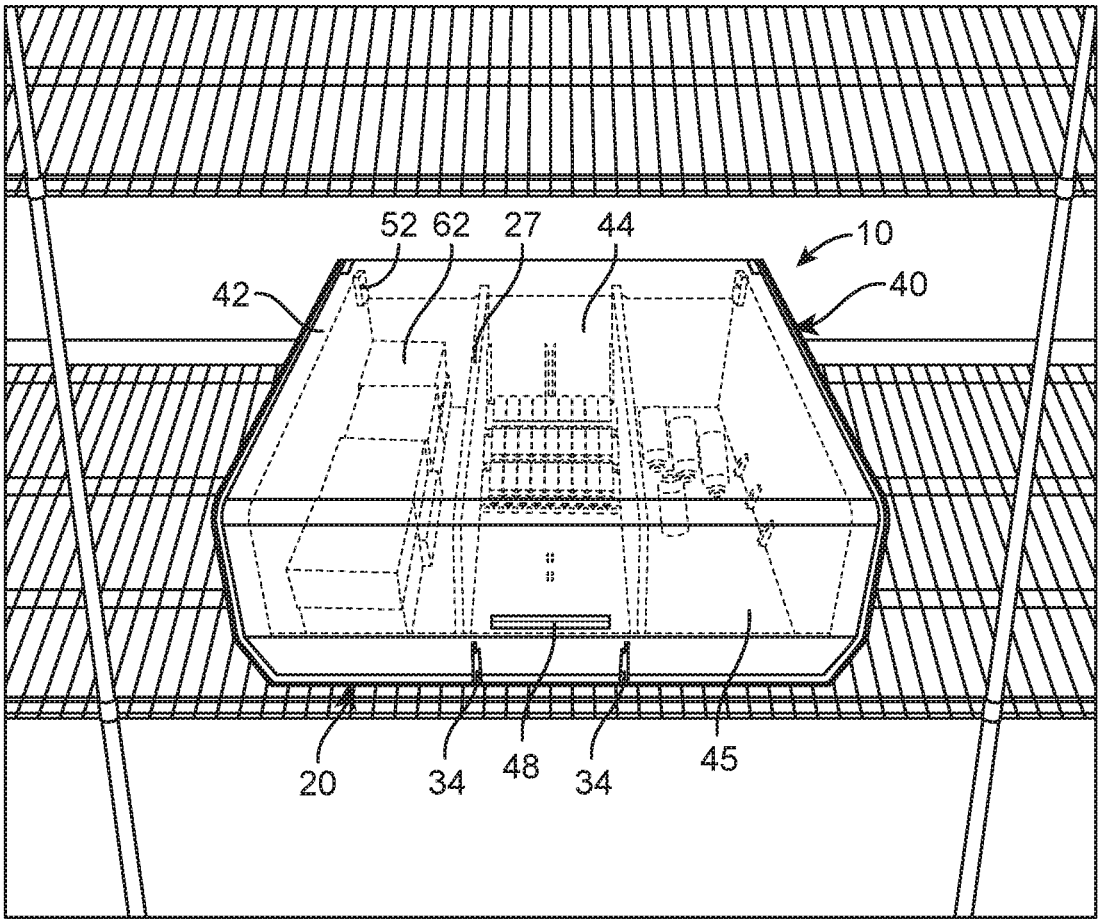
FIG. 1 represents the present invention in an operational setting with medications stored within.

Referring now to the drawings, where the present invention, a medication storage container 10, is generally referred to with numeral 10, it can be observed that it basically includes a container assembly 20 and a cover assembly 40.

Referring to FIG. 1 it can be seen that the present invention, medication storage container 10, can be used to hold and store medications 62 within. Preferably, medications 62 are light sensitive medications that need minimal light exposure to maintain their effectiveness and remain undamaged. Medications 62 may be in the form of liquids, pills, capsules, drops, inhalers, injections, topical medicines, suppositories or the like as known in the medical field.

It can be seen that the present invention includes container assembly 20 which includes a container 22. Within container 22 is where medications 62 may be held and stored. Container 22 may preferably be a rectangular box. However, it should be understood that container 22 is not limited to being as such. It may be suitable, in alternate embodiments, for container 22 to be of a predetermined shape and dimensions. Container 22 may preferably be made of plastic for the purpose of durability and light weight, but other materials such as aluminum, rubber, glass or the like may be suitable as well. Container 22 may include sidewalls 24 and floor 26. Each of sidewalls 24 may extend from floor 26 a predetermined distance about a perimeter of floor 26. The majority of sidewalls 24 may be of a same height. Each of sidewalls 24 may be of predetermined shape and dimensions. However, one of sidewalls 24, more specifically, front sidewall 25 may be substantially shorter than the remaining of sidewalls 24. Being that container 24 may preferably be a rectangular box shape, sidewalls 24 at the front and rear of container 24 may be of a same width. While sidewalls 24 on lateral sides of container 24 may be of a same width. It should be understood that medications 62 may be held and stored within sidewalls 24 and on floor 26. Extending along the bottom of front sidewall 25 may be a lip. Centrally located on an exterior of front sidewall 25 may be a label holder 34 adapted to hold a label for the purpose of identify which of medications 62 are being stored within the present invention. Label holder 34 may include a left and right portion. Each of the left and right portion of label holder 34 may preferably be L shaped when seen from above, however, it should be understood that other predetermined shape and dimensions may be suitable for label holder 34. The left and right portion of label holder 34 may face towards each other. Label holder 34 may protrude outwardly and away from front sidewall 25 a predetermined amount. The label may be held atop of the lip on the front sidewall 25 and in between the left and right portion of label holder 34.

Figure 4:
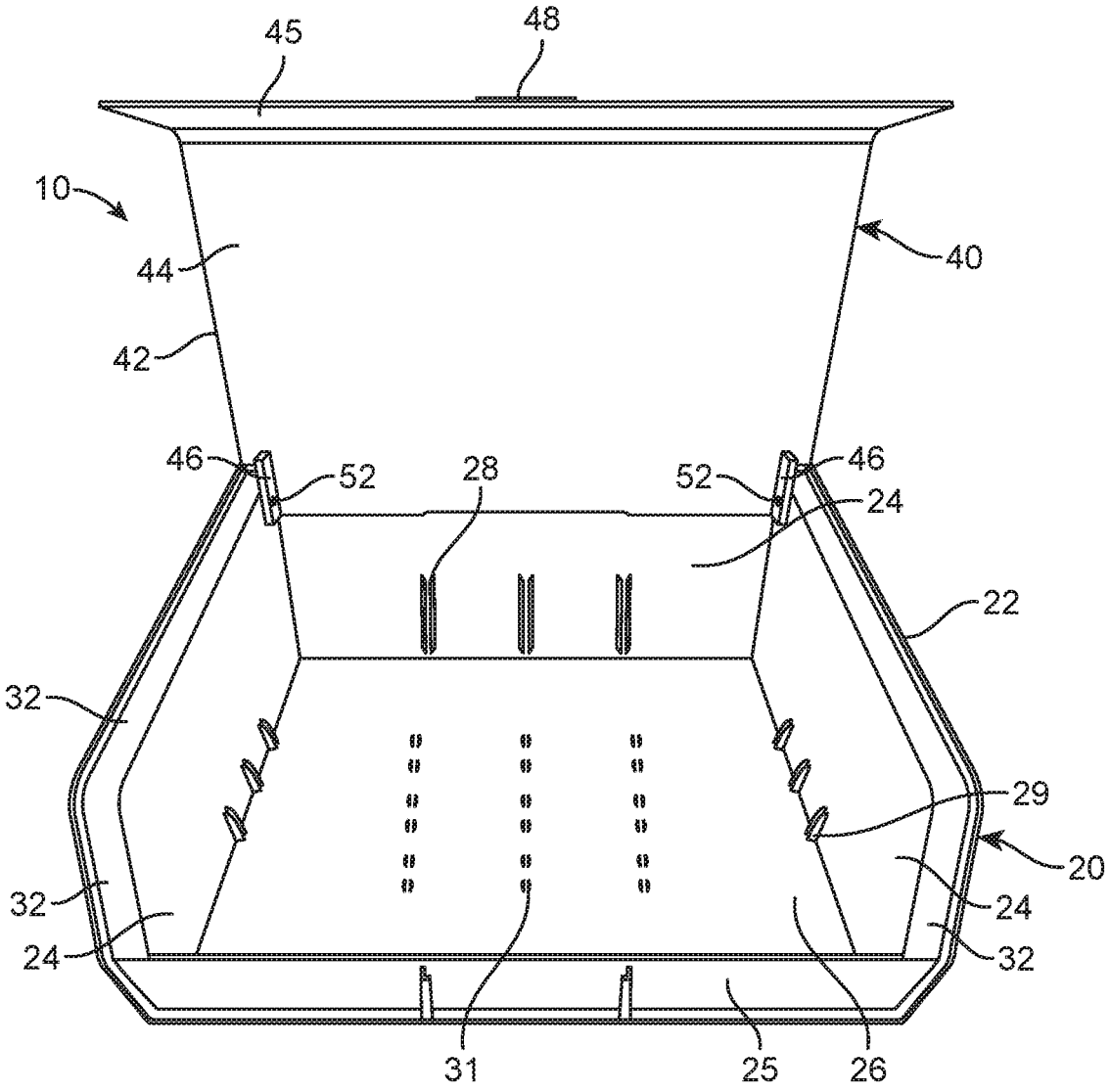
FIG. 4 illustrates an isometric view of the present invention in an open configuration.
Figure 5:
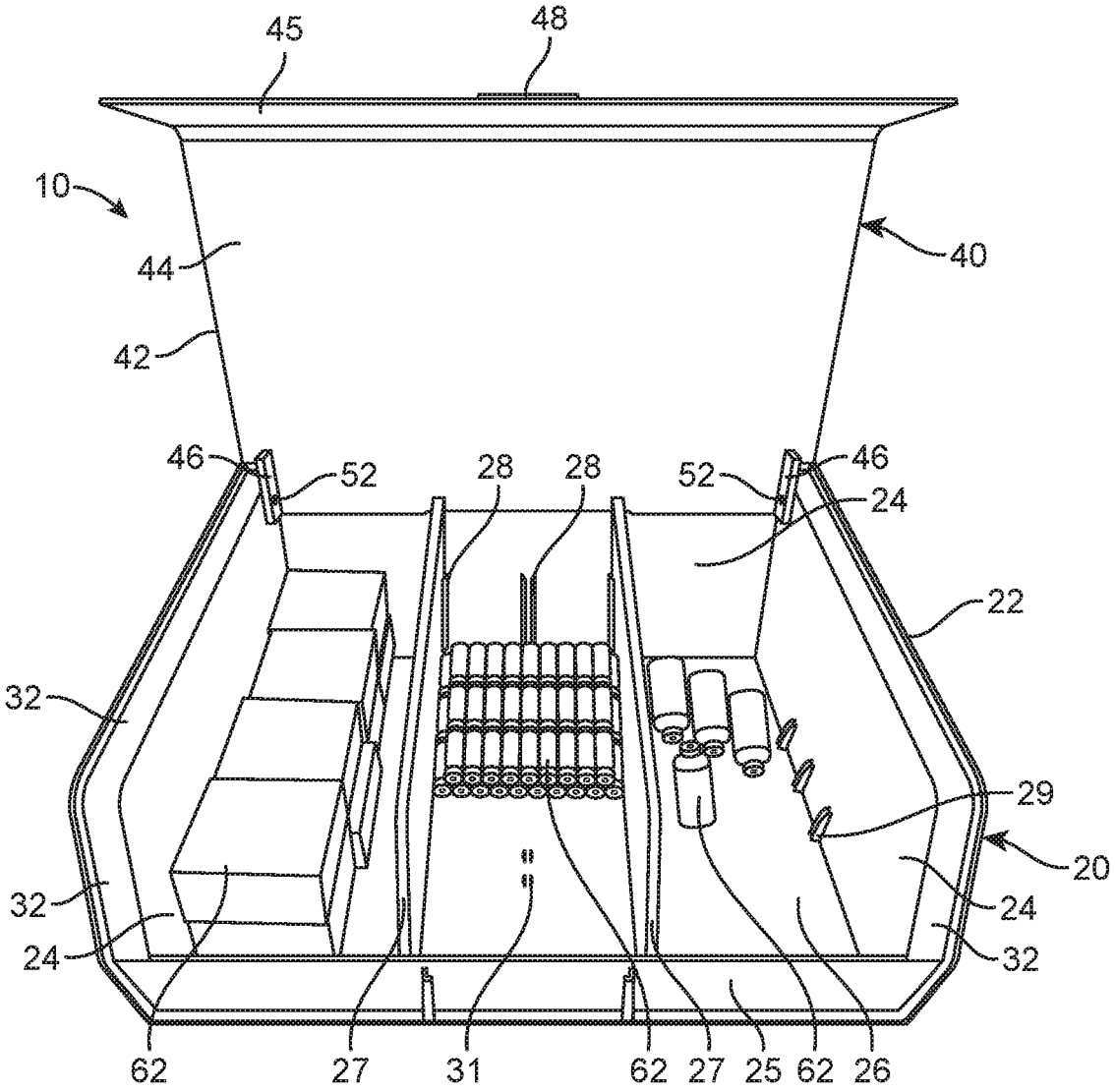
FIG. 5 is a representation of dividers being used to organize and separate different medications within one storage bin in one configuration.

It may be suitable to use the present invention to organize and separate medications 62 within container 22, as can be seen in FIG. 4 and FIG. 5. Medications 62 may be separated and organized with the use of at least one divider 27 extending along an interior of container 22. At least one divider 27 may be used to separate container 22 into smaller compartments or subsections for the purpose of organization. At least one divider 27 may be oriented and extended about a length of container 22 as can be seen in FIG. 4. At least one divider 27 may also be oriented and extended about a length of container 22 as can be seen in FIG. 5. At least one divider 27 may be of a predetermined shape and dimensions. However, in one embodiment, at least one divider 27 may be rectangular shaped. Sidewalls 24, along an interior side, may include first divider holders 28 or second divider holder 29 to secure at least one divider 27 within container 22. Floor 26 may include divider guides 31 at predetermined locations. Divider guides 31 to guide at least one divider 27 so that the subsections created by at least one divider of adequate and appropriate size or sizing. In one embodiment, divider guides 31 may be oriented to extend along a length of container 22. However, it may be suitable for divider guides 31 to be oriented to extend along a width of container 22. It should be understood that first divider holders 28 may be of dimensions greater than those of second divider holders 29. The length of first divider holders 28 may be greater than the length of second divider holder 29. First divider holders 28 may be located on sidewalls 24 which are at a front and rear of container 22. While second divider holders 29 may be located on sidewalls 24 which are at lateral sides of container 22. Both of first divider holders 28 and second divider holders 29 may extend from floor 26 and along sidewalls 24. With at least one divider 27 extended between sidewalls 24 of container 22, container 22 may be divided into separated spaces. With first divider holders 28, at least one divider 27 may be extended longitudinally along container 22. With second divider holders 29, at least one divider 27 may be extended latitudinally along container 22. Each of the separated spaces may be used to hold different of medications 62, for example. At least one divider 27 are secured between either first divider holders 28 or second divider holders 29. More of at least one divider 27 being used allows for more separation of medications 62, however, the separating spaces may become smaller in such a case. Divider guides 31 aid in keeping at least one divider 27 straight and in line along floor 26. At a top side and partially along a front side of sidewalls 24 located on lateral sides of container 22 and on an interior of container 22 may be a cover support 32. Cover support 32 may aid in maintaining a cover 42 of cover assembly 40 securely in place. Along lateral sides of container 22 on an exterior of container 22 may be a carrying handle 36. Carrying handle 36 may aid in allowing ease of transportation of the present invention. Carrying handle 36 may be shaped as ridges for receiving the fingers of a user. In one embodiment, carrying handle 36 may include four ridges for all fingers except the thumbs of the user. Container 22 may include support feet 38 along the bottom thereof. More specifically, support feet 38 may be under sidewalls 24 on lateral sides of container 22. Support feet 38 may be adapted to provide stability to container 22 when placed on a surface, preferably a flat surface. Support feet 38 may extend along a length of sidewalls 24 on lateral sides of container 22. Support feet 38 may protrude outwardly from sidewalls 24. Support feet 38 may further facilitate mounting of more than one of container 22 atop of each other.

Figure 2:
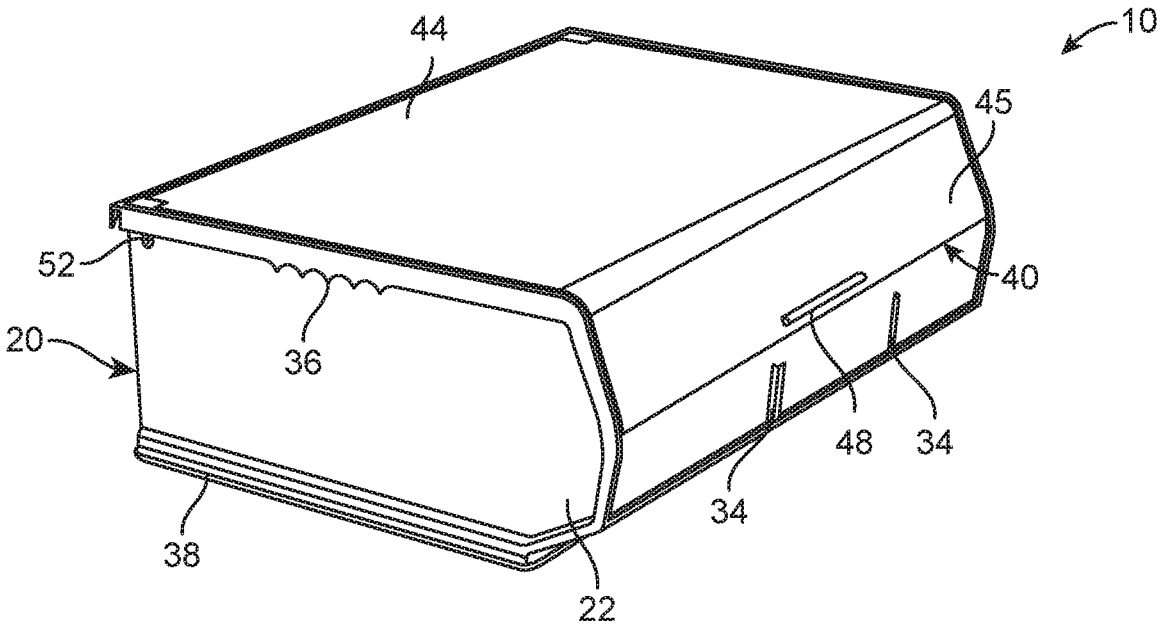
FIG. 2 shows an isometric view of the present invention in a closed configuration.
Figure 3:
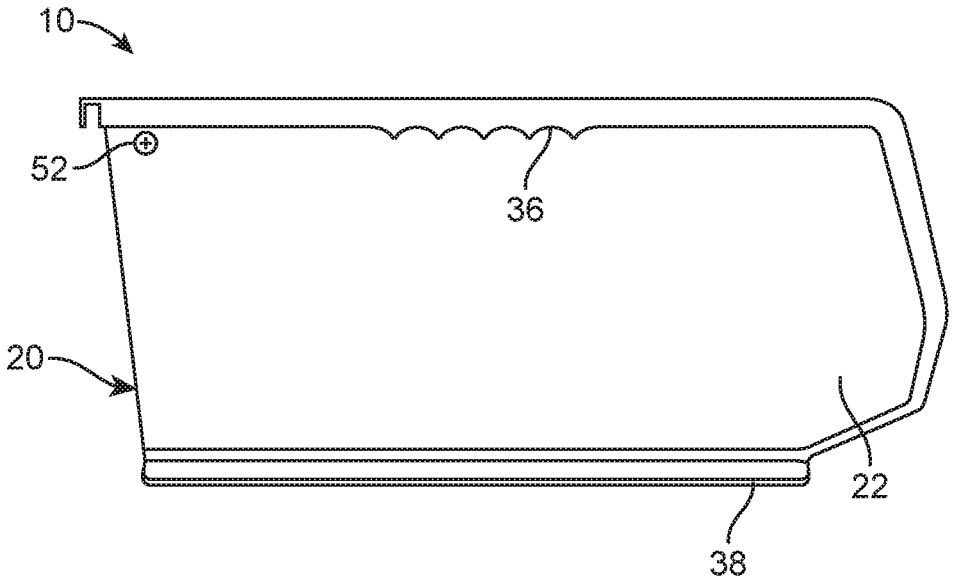
FIG. 3 shows a side view of the present invention to show the mechanism that allows for carrying of the present invention and also mechanism that provides support to the present invention.

Medication storage container 10 may further include cover assembly 40. Cover assembly 40 may be hingedly mounted to container assembly 20. Cover assembly 40 may include cover 42 mounted to container 22. Cover 42 may be adapted to shield or protect the interior of container 22 and more importantly the contents within container 22. In an alternate embodiment, cover 42 may be removably mounted to container 22. Cover 42 may be of dimensions and shape that cooperate with the dimensions and shape of container 22. In one embodiment, cover 42 may be a retractable cover. It may be preferable for cover 42 to be made of plastic. However, it may be suitable for cover 42 to be made of glass, acrylic or the like, in alternate embodiments. Importantly, cover 42 may be tinted to reduce the amount of light exposure received by medications 62 stored within container 22. Cover 42 may be semitransparent. In an alternate embodiment, it may be suitable for cover 42 to be opaque. Cover 42 may preferably be tinted an amber color. It may also be suitable for cover 42 to be made from a tinted amber colored material. Medication storage container 10, and more specifically, container 22 may have a closed and open configuration. Cover 42 may have a lowered or raised configuration. When cover 42 is in the lowered configuration, container 22 may be in the closed configuration, as seen in FIG. 2. When cover 42 is in the raised configuration, container 22 may be in the open configuration, as seen in FIG. 3. Cover 42 may sit on cover support 32 when in the closed configuration. Cover 42 may be slightly recessed within container 22 when cover 42 is on cover support 32. Cover 42 may include a top portion 44 and a front portion 45. Cover 42 extends between sidewalls 24. Top portion 44 may extend between sidewalls 24 being on lateral sides from the top. Front portion 45 may extend between sidewalls 24 being on lateral sides from the front. Front portion 45, when cover 42 is in the closed configuration, may be flush on front sidewall 25. Top portion 44 and front portion 45 may be integral. There may be a curvature where top portion 44 and front portion 45 meet. On front portion 45 there may be a lifting handle 48 included. Lifting handle 48 may aid in being able to lower and raise cover 42. Mounting of cover 42 to container 22 may occur with attaching portions 46. Attaching portions 46 may be mounted underneath of cover 42 at a rear side of cover 42. In one embodiment, attaching portions 46 may be rectangular. However, it should be understood that it may be suitable for attaching portions 46 to be of predetermined shape and dimensions. Attaching portions 46 may allow for cover 42 to be hingedly mounted to cover 22 for achieving the lowered and raised configurations. Attaching portions 46 may be mounted to sidewalls 24 on lateral sides of container 22. Attaching portions 46 may be in abutting contact with sidewalls 24 at predetermined locations. Attaching portions 46 may be secured to container 22 with the use of fasteners 52. Fasteners 58 allow cover 42 to rotate to open and close container 22. Fasteners 52 may be screws, nails, hook and loop straps, zip ties, snap buttons or the like as known in the art. Cover 42 rotate about fasteners 58.

Figure 6:
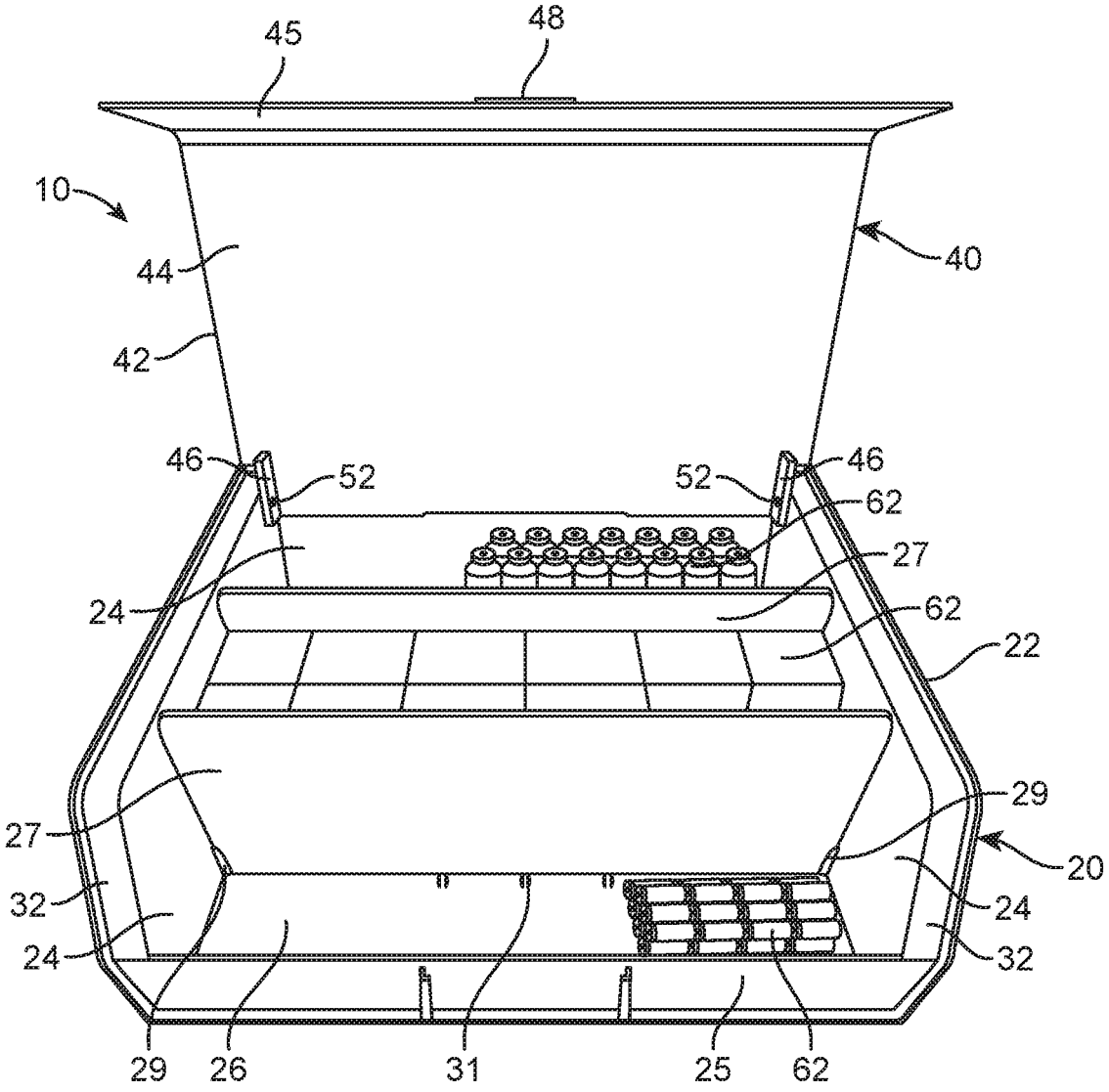
FIG. 6 is a representation of dividers being used to organize and separate different medications within one storage bin in another configuration different from FIG. 4.
Figure 7:
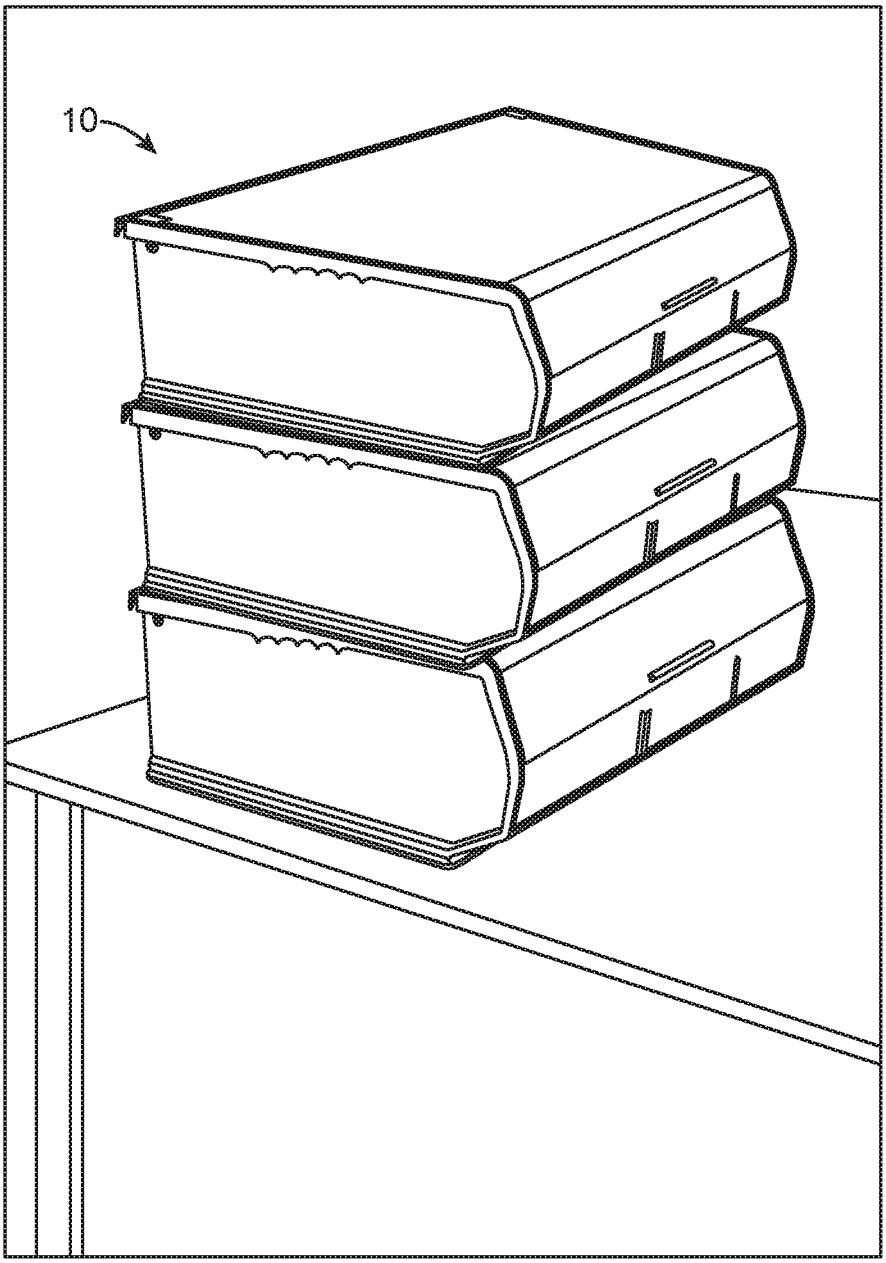
FIG. 7 shows how a storage bin of the present invention may be stacked upon additional storage bins.

The present invention allows for protecting of medications 62 that may be light sensitive. The protection of the medications helps to maintain medications 62 undamaged in order for them to maintain their effectiveness. Medications 62 may be stored within container 22 and covered by cover 42 for protection. Cover 42 may be tinted an amber color or by an amber colored material that still permits visibility of the contents within container 22 without allowing much light inside. The present invention may allow for exposing medications 62 to light only when absolutely necessary such as when there is a need to refill container 22 or when one of medications 62 is to be retrieved. Additionally, storage of medications 62 can be done easily as container 22 may be stackable with other of container 22 as seen in FIG. 6.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a medication container comprising:

a. a container assembly including a container with sidewalls and a floor, one of said sidewalls being a front sidewall, said sidewalls extending about a perimeter of said floor, said sidewalls located on lateral sides of said container, said container having a closed and open configuration, said container includes at least one divider adapted to separate said container into subsections, said sidewalls along an interior include first divider holders or second divider holders, said at least divider extends about said container once secured to one of said first divider holders or said second divider holders, said first divider holders are located on said sidewalls located at a rear and a front of said container, said sidewalls on said front being said front sidewall;

b. a cover assembly including a cover, said cover including attaching portions to hingedly mount said cover to said container, said attaching portions secured to said cover with fasteners, said cover being lowered or raised to allow said container to achieve said closed and open configuration, respectively, said cover being tinted; and c. medications, said medications being light sensitive medications, said medications are stored within said container and are protected from light exposure with said cover when said cover is lowered and said container is closed.

2. The system of claim 1, wherein said cover is made of a tinted amber colored material to provide light protection to said medications stored within said container.

3. The system of claim 1, wherein said container is a rectangular box.

4. The system of claim 1, wherein said cover is made of plastic.

5. The system of claim 1, wherein said cover is a retractable cover.

6. The system of claim 1, wherein said second divider holders are located on said sidewalls located on said lateral sides of said container.

7. The system of claim 1, wherein said floor includes divider guides extending about a length of said floor to guide said at least one divider within said container to allow adequate sizing of said subsections.

8. The system of claim 1, wherein said front sidewall includes a label holder on an exterior thereof, said label holder adapted to hold a label for ease of identifying said medications within said container.

9. The system of claim 1, wherein said sidewalls on said lateral sides of said container include a carrying handle on an exterior, said carrying handle adapted to allow a user to easily carry or transport said container.

10. The system of claim 1, wherein said container includes support feet at a bottom said container, said support feet provide stability to said container when placed on a surface or another of said container.

11. The system of claim 1, wherein said cover includes a top portion and a front portion.

12. The system of claim 11, wherein said front portion includes a lifting handle adapted to facilitate the lowering and raising of said cover.

13. The system of claim 1, wherein said front sidewall is shorter in a height than all other remaining of said sidewalls, said height is defined as a measurement from a bottom edge of the front sidewall to a top edge of the front sidewall.

14. The system of claim 1, wherein said fasteners are one of screws, nails, hook and loop straps, zip ties or snap buttons.

15. A system for a medication container comprising:

a. a container assembly including a container with sidewalls and a floor, one of said sidewalls being a front sidewall, said sidewalls extending about a perimeter of said floor, said sidewalls located on lateral sides of said container, said container having a closed and open configuration, said front side wall being shorter than remaining of said sidewalls, said front sidewall including a label holder on an exterior thereof, said label holder adapted to hold a label for ease of identification said container and contents held therein, said sidewalls on said lateral sides including a carrying handle for ease of carrying and transporting said container, said container further including support feet underneath of said container adapted to provide stability to said container when on a flat surface, said container assembly further includes at least one divider, said at least one divider extended along an interior of said container to separate said container into subsections, said sidewalls including one of first divider holders or second divider holders along an interior thereof, said first divider holders being located on said sidewalls at a rear and front of said container, said second dividers being located on said sidewalls on said lateral sides of said container, said first divider holders being greater in length than said second divider holders, said at least one divider extends longitudinally with said first divider holders and said at least one divider extends latitudinally with said second divider holders, said floor including divider guides to guide said at least one divider to allow for said subsections to be of adequate sizing, said container being a rectangular box;

b. a cover assembly including a cover, said cover including attaching portions to hingedly mount said cover to said container to shelter the contents stored within said container, said attaching portions secured to said cover with fasteners, said cover being lowered or raised to allow said container to achieve said closed and open configuration, respectively, said cover being made of a tinted amber colored material, said cover including a front portion, said front portion having a lifting handle mounted thereto, said lifting handle adapted to facilitate said cover being lowered or raised; and c. medications, said medications being light sensitive medications, said medications are stored within said container and are protected from light exposure with said cover when said cover is lowered and said container is closed.

16. The system of claim 15, wherein said cover is retractable.

* * * * *